United States Patent [19]

Schiff

[11] 3,995,847

[45] Dec. 7, 1976

[54] OFFICE MACHINE INCLUDING RETRACTABLE FEEDER

[76] Inventor: Joseph Schiff, 5 Lipski St., Tel Aviv, Israel

[22] Filed: Apr. 28, 1975

[21] Appl. No.: 572,188

Related U.S. Application Data

[63] Continuation-in-part of Ser. No. 428,867, Dec. 27, 1973, Pat. No. 3,891,203.

[52] U.S. Cl. ..... 270/58; 271/4; 271/9; 271/121; 271/162

[51] Int. Cl.[2] ..... B65H 37/04; B65H 3/116

[58] Field of Search ..... 271/4, 8, 9, 121, 122, 271/35, 124, 125, 137, 138, 162, 164; 270/39, 58; 156/542, 571

[56] References Cited

UNITED STATES PATENTS

| | | | |
|---|---|---|---|
| 2,085,248 | 6/1937 | Bishop | 271/174 |
| 2,907,567 | 10/1959 | Schneider et al. | 271/35 |
| 3,721,601 | 3/1973 | Pituch et al. | 271/9 |
| 3,857,559 | 12/1974 | McInerny | 271/122 |

FOREIGN PATENTS OR APPLICATIONS

| | | | |
|---|---|---|---|
| 504,512 | 7/1930 | Germany | 271/4 |

*Primary Examiner*—Robert W. Saifer
*Attorney, Agent, or Firm*—Benjamin J. Barish

[57] ABSTRACT

An office machine includes a pair of input feeders and an output feeder for processing flat articles, such as for automatically labeling envelopes. One input feeder for feeding the blank envelopes includes an elongated member formed with a rounded lower end facing the entrance to the feeder, and a roller disposed under the elongated member in alignment with its rounded lower end. The elongated member is pivotably mounted such that its rounded lower end is urged against the roller, the surface friction of the roller being greater than that of the rounded lower end to effect the feed of one envelope at a time between them. The output feeder includes a conveyor platform having a plurality of hinged sections permitting the platform to be disposed in either an extended operative position wherein the hinged sections are extended for conveying the labeled envelopes, or in a folded non-operative position wherein the hinged sections are folded to conform to the configuration of the machine casing. The second input feeder is for a carrier-strip carrying the labels to be applied to the blank envelopes, this feeder including a retractable support for supporting same in a projected position external of the machine casing when the conveyor platform is in its extended operative position, or in a retracted position within the machine casing when the conveyor platform is in its folded non-operative position.

12 Claims, 7 Drawing Figures

OFFICE MACHINE INCLUDING RETRACTABLE FEEDER

RELATED APPLICATION

This application is related to and is a continuation-in-part of my previous U.S. patent application Ser. No. 428,867, filed Dec. 27, 1973 now U.S. Pat. No. 3,891,203 granted June 24, 1975.

BACKGROUND OF THE INVENTION

The present invention relates to office machines of the general type which includes flat article feeders. The invention is particularly useful with respect to automatic envelope-labeling machines, such as described in my British Patent Specification 29062/73, and is therefore described with respect to that type machine.

There are a large number of office machines in which a plurality of flat articles (e.g., envelopes) are processed (e.g., labeled) and then fed from the processing station within the machine to another station outside of the machine, such as a stacker for stacking the articles in a pile. As a rule, such machines are large and bulky, and therefore occupy a considerable amount of office space both in their operating and non-operating conditions. Further, many machines include feed arrangements which do not permit continuous loading while the machine is in operation, and/or which cannot accommodate at one time flat articles of different dimensions.

My above-cited U.S. patent application Ser. No. 428,867 filed Dec. 27, 1973, now U.S. Pat. No. 3,891,203 describes an office machine particularly useful as an automatic envelope-labeling machine in which the output feeder includes a conveyor platform having a plurality of hinged sections permitting the platform to be disposed in either an extended operative position for conveying the processed flat articles (labeled envelopes), or in a folded non-operative position wherein the hinged sections are folded to conform to the configuration of the machine casing. The machine described in that application also includes an input feeder for getting the unlabled envelopes into the machine. The input feeder therein described permits continuous loading while the machine is in operation, and also accommodates at one time envelopes of different dimensions.

BRIEF SUMMARY OF THE INVENTION

The present invention relates to improvements in the office machine of my above cited U.S. patent application.

According to one improvement, the second input feeder (which in the described embodiment feeds a carrier strip containing the labels to be applied to the envelopes) is retractably supported so that it can be moved either to a projected position external of the machine casing when the conveyor platform is in its extended operative position, or to a retracted position within the machine casing when the conveyor platform is in its folded non-operative position. In the preferred arrangement described, this second feeder includes a supporting platform and a pair of guide rollers for the carrier strip, each of the rollers being pivotably mounted on the platform from an operative position spaced above the platform to a non-operative position against the platform, and a pivotable arm supporting the platform in the projected or retracted positions.

According to a second feature of the present invention, the input feeder for feeding the blank envelopes includes an elongated member extending across the entrance of the feeder and formed with a rounded lower end facing that entrance. The feeder further includes a roller disposed under the elongated member in alignment with its rounded lower end, and pivotable mounting means pivotably supporting the elongated member laterally of the axis of the roller in the direction towards the feeder entrance, whereby the rounded lower end of the elongated member is urged against the roller by the weight of the elongated member. The surface friction of the roller is greater than that of the rounded lower end of the elongated member. This arrangement effects the feed of one envelope at a time between the eccentrically mounted elongated member and the roller.

In the preferred embodiment of the invention described, the envelope feeder includes a spring urging the rounded lower end of the elongated member against the roller. In addition the elongated member has a cross-sectional shape of a quarter-sector of a circle, and the roller disposed thereunder is made of soft sponge-rubber.

According to a further feature, the envelope feeder includes an entrance plate at the entrance side of the elongated member and roller, the entrance plate having a tapered lower end facing the entrance, spaced forwardly of the elongated member and roller and above the line of engagement therebetween. This feature causes the blank envelopes in the supply station to be spread out before arriving at the line of engagement of the rounded lower end of the elongated member with the roller, which has been found to better assure the feeding of only one envelope at a time between the member and roller.

According to a still further feature, the blank envelope feeder also includes a sensor for sensing the presence of envelopes in the supply station, and a locking device locking the roller against rotation whenever the sensor senses the absence of the envelopes in the supply station.

Further features and advantages of the invention will be apparent from the description below.

BRIEF DESCRIPTION OF THE DRAWINGS

The invention is herein described, by way of example only, with reference to a preferred embodiment illustrated in the accompanying drawings, wherein.

DESCRIPTION OF THE PREFERRED EMBODIMENT

Figures 1, 3:
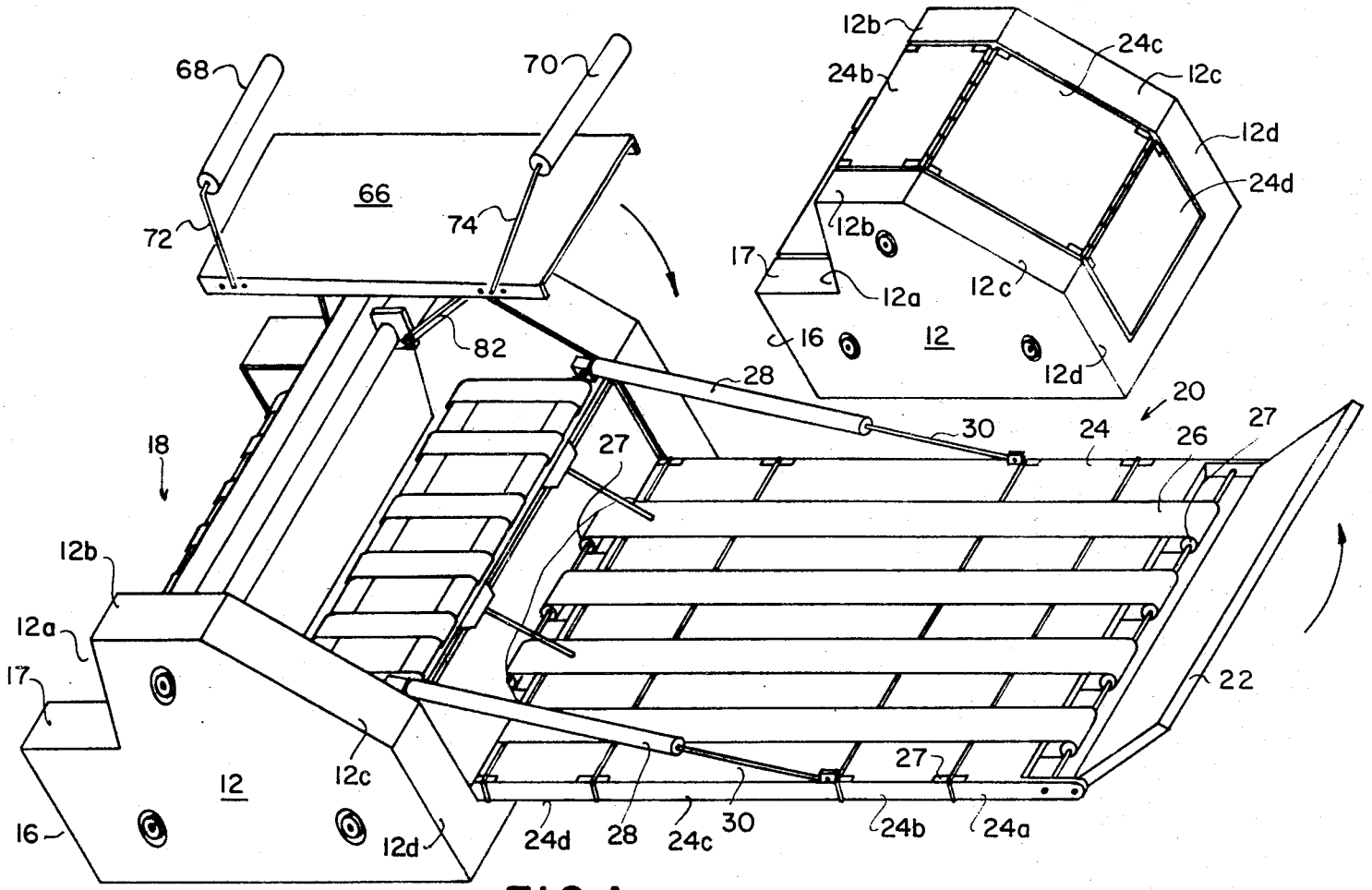
FIG. 1 is a perspective view illustrating an automatic envelope labelling machine constructed in accordance with the invention.
FIG. 3 illustrates the machine of FIGS. 1 and 1*a* in its non-operative condition.

The office machine illustrated in the drawings is an automatic envelope-labelling machine, such as described in my co-pending U.S. patent application Ser. No. 428,867, filed Dec. 27, 1973 now U.S. Pat. No. 3,891,203. In such a machine, the flat articles fed into the machine are envelopes which are processed within the machine by having labels applied to them. The so-labelled envelopes are fed out of the machine to a stacker or to another machine, for example a franking machine, for further processing.

As best seen in FIG. 1, the machine comprises a casing, generally designated 12, supported on a rectangular frame 14. The casing is of a straight-line external configuration including (from front-to-rear): a front vertical wall 16 joined to a flat horizontal surface 17, another vertically-rising surface 12*a*, a top horizontal surface 12*b*, a sloping descending surface 12*c*, and finally a vertically descending surface 12*d*.

Figure 2:
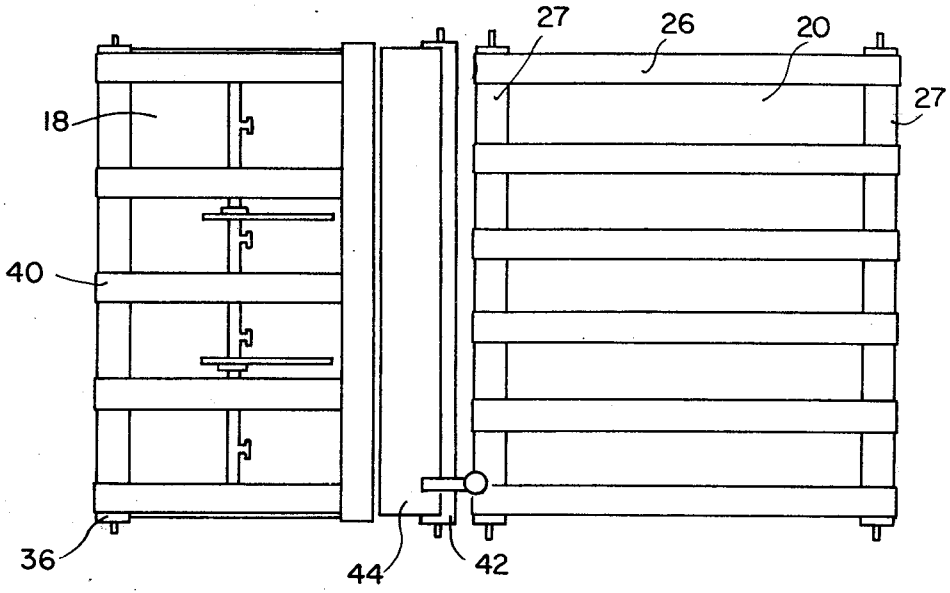
FIG. 2 is a top plan view illustrating the machine of FIGS. 1 and 1*a*, with parts removed for purposes of simplifying the illustration.

At the front end of the casing there is provided the input feeder, generally designated 18 (FIG. 2) for feeding the envelopes to the automatic labelling unit housed within the casing, and at the rear end of the machine there is provided the output feeder generally designated 20 for feeding the stacked envelopes from the labelling unit out of the machine. The input feeder 18 is more particularly illustrated in FIGS. 4–6. The labelling unit itself is not shown but one that may be used is illustrated in my British Patent Specifications 29062/73.

The output feeder 20, as shown in FIG. 1, carries at its outer extremity a pivotable stacker member 22 which stacks the labelled envelopes into a pile as they are fed out of the machine. Feeder 20 further includes a conveyor platform, generally designated 24, and a plurality of conveyor belts 26 driven by rollers 27. Platform 24 is constituted of a plurality of separate sections hinged together to permit the sections to be disposed in the extended operative position illustrated in FIG. 1, or in a folded non-operative position as shown in FIG. 3. In the latter position, the sections are folded to conform to the external configuration of, and to serve as part of, the machine casing.

Thus, as shown in FIGS. 1 and 3, the conveyor platform 24 includes four sections 24*a* – 24*d* all connected together by hinges. During the normal use of the machine, conveyor platform 24 is disposed in the extended position illustrated in FIG. 1, by means of a pair of telescoping arms 28, 30, pivotably mounted at each side of the conveyor platform between same and the machine. In this extended position, the platform is adapted to receive the labelled envelopes from the processing station within the machine, and to convey them by means of belts 26 to stacker member 22 where the envelopes are stacked in a pile. When the machine is not in use, platforms sections 24 may be folded into the position illustrated in FIG. 3, wherein platform sections 24*a* – 24*d*, corresponding in dimensions to the respective surfaces 12*a*–12*d* of the machine casing, conform to the external shape of the machine casing and serve as a part of it.

Thus, the output feeder may be folded with respect to the machine casing so as to form a very compact unit that takes very little space when not in use, when stores, or when being transported to another location.

The input feeder 18 for feeding the envelopes into the machine is best seen in FIGS. 2 and 4–6. It includes a pair of rollers 26, 38 carrying betweeen them a plurality of webs 40 for supporting the stack of envelopes, a roller 42 immediately rearwardly of and in alignment with roller 38, and an elongated stripper member 44 for assuring that only one envelope is fed at a time from the bottom of the stack supported on webs 40. Rollers 36, 38 and 42, and stripper member 44 are preferably all of a transverse dimension greater than the length of the envelopes, so that the envelopes can be fed width-wise as well as length-wise into the machine.

Figure 4:
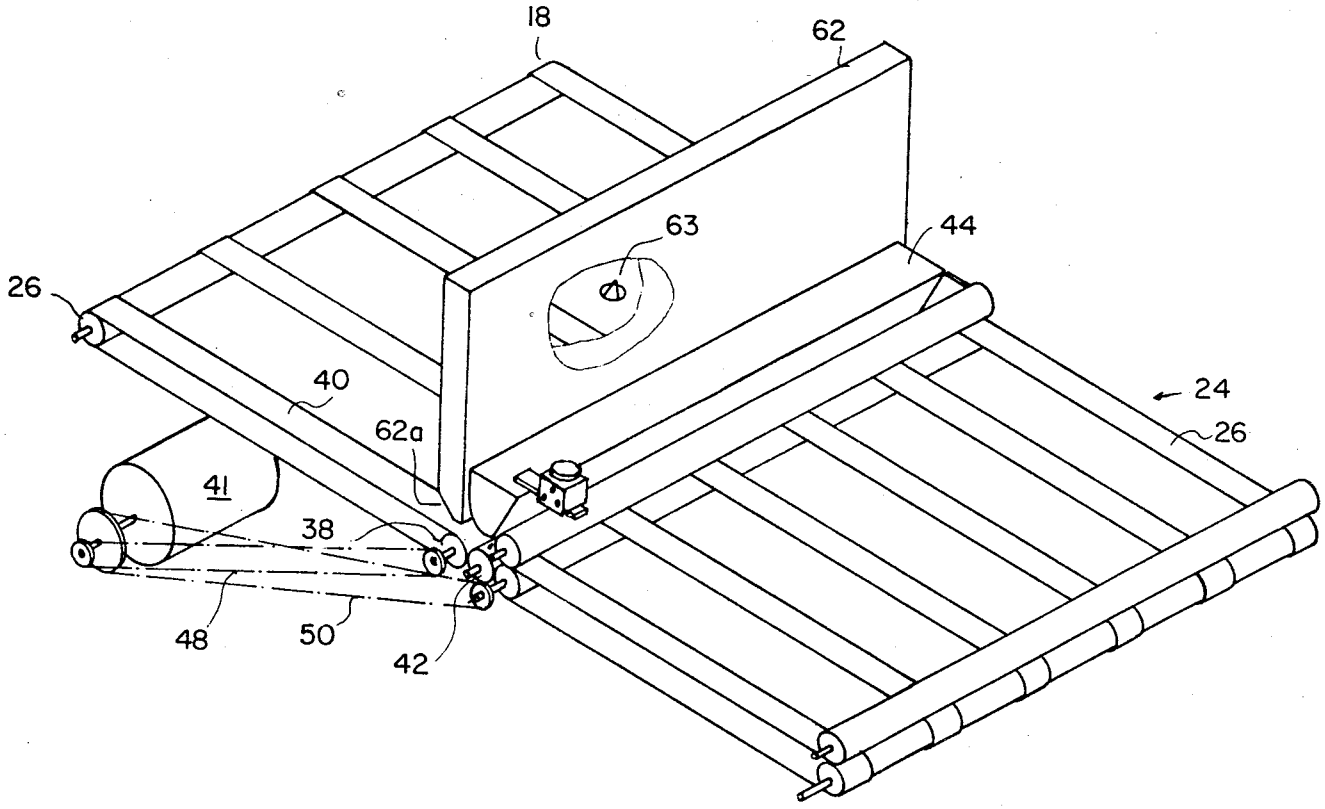
FIGS. 4 and 5 are enlarged perspective views of parts of the blank envelope input feeder of the machine.

Roller 38 driving webs 40, and roller 42, are both driven by motor M via belts 48 and 50 (FIG. 4), the direction of rotation of belts 40 and roller 42 such as to move the envelopes towards member 44, i.e., from left-to-right in FIG. 4.

Figure 5:
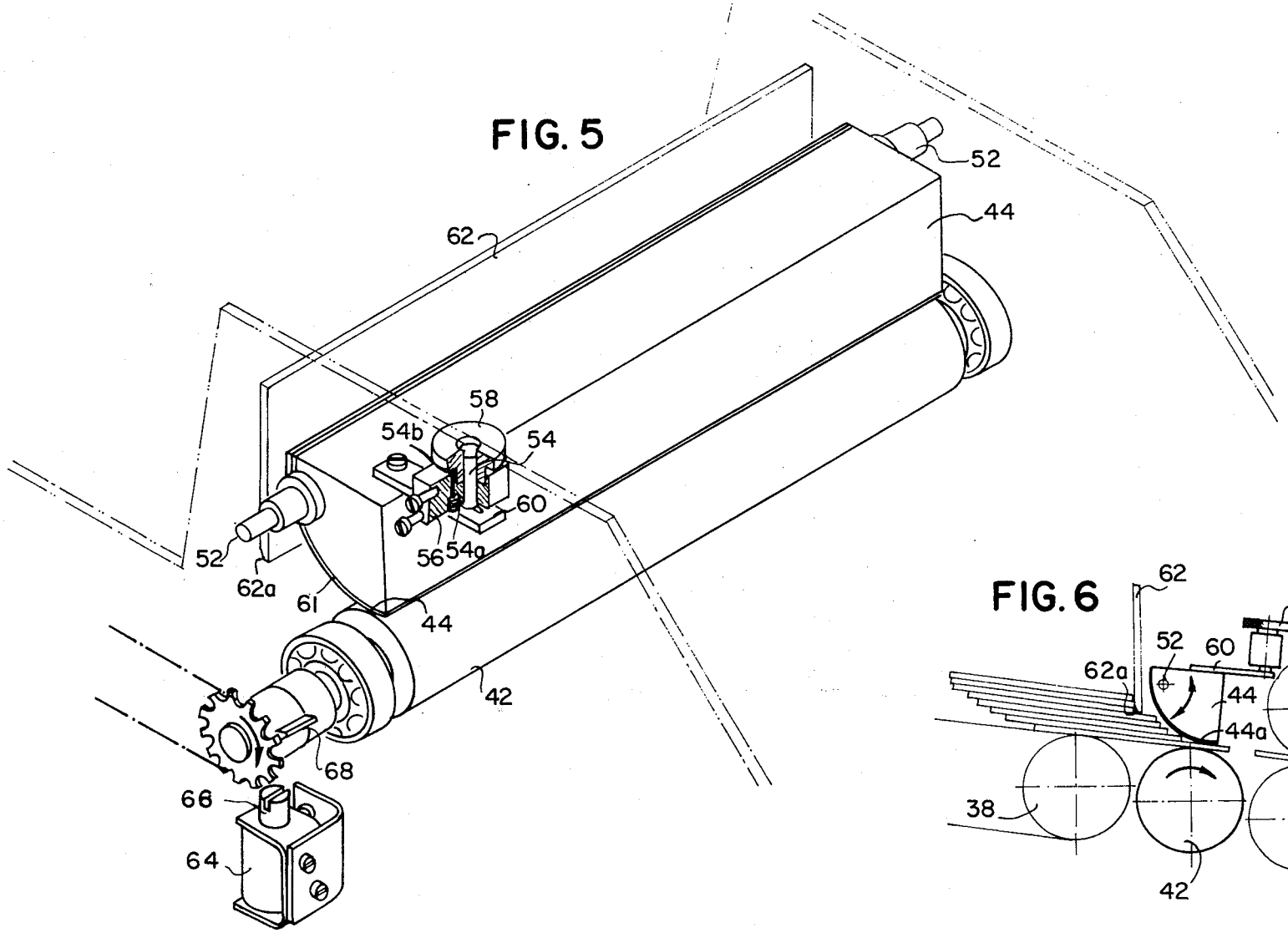
Figure 6:
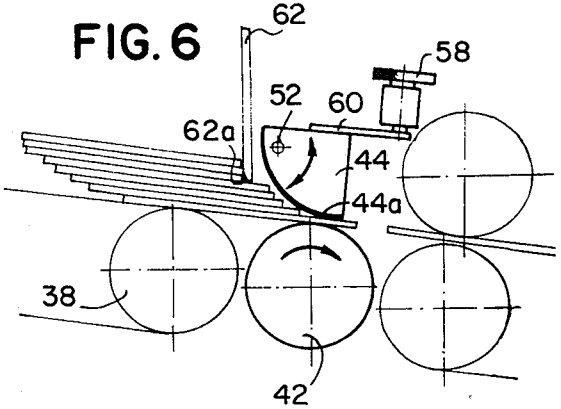
FIG. 6 is a side elevational view illustrating the operation of the blank envelope feeder of FIGS. 4 and 5.

Stripper member 44 has a cross-sectional shape of a quarter-sector of a circle, as best seen in FIGS. 4–6. It is pivotably supported by a pair of pins 52 from the machine frame along an axis laterally of the axis of roller 42, in the direction towards the entrance of the feeder (leftwardly in FIGS. 4–6), so that by virtue of its eccentric mounting, the rounded lower end 44*a* of the member is urged towards roller 42 by the weight of the member itself. The degree of force or bias of member 44 against roller 42 can be adjustably increased by means of a pin 54 (FIG. 5) disposed within a housing 56 fixed to the machine frame, the pin including an enclosed head 58 and a shank 54*a* threadly received within housing 56 to engage a tab 60 carried by a stripper member 44.

Stripper member 44 includes an outer layer 61 of a material having a coefficient of friction less than that of the outer surface of roller 42. This enables the roller 42 to pass the individual envelopes between it and the lower rounded end 44*a* of member 44 while the latter member assures that only one envelope will be fed by the roller at a time. Preferably the outer surface of roller 42 may be of soft sponge-rubber of high friction having a hardness of 25–35 shore, and layer 61 of stripper member 44 may be of a plastic such as nylon.

An entrance plate 62 is disposed at the entrance side of stripper member 44 and roller 42. Plate 62 is provided with a lower tapered edge 62*a*, formed by cutting the lower edge at a 45° angle. This tapered edge, which faces the feeder entrance and is disposed forwardly of stripper member 44 and roller 42, and above the line of engagement therebetween (see FIG. 6), has been found to effectively spread the envelopes before they arrive at stripper member 44, and thereby to better assure that only one envelope will be fed at a time between the stripper member and roller 42.

The input feeder 18 preferably includes a sensor switch 63 (FIG. 4) projecting between bolts 40 to sense the presence of envelopes in the supply station. If no envelopes are sensed, switch 63 controls a solenoid 64 (FIG. 5) having an armature 66 which is projected into blocking engagement with a tooth 68 fixed to the shaft of roller 42. This locks roller 42 against rotation whenever no envelopes are sensed in the supply station.

Figure 1A:
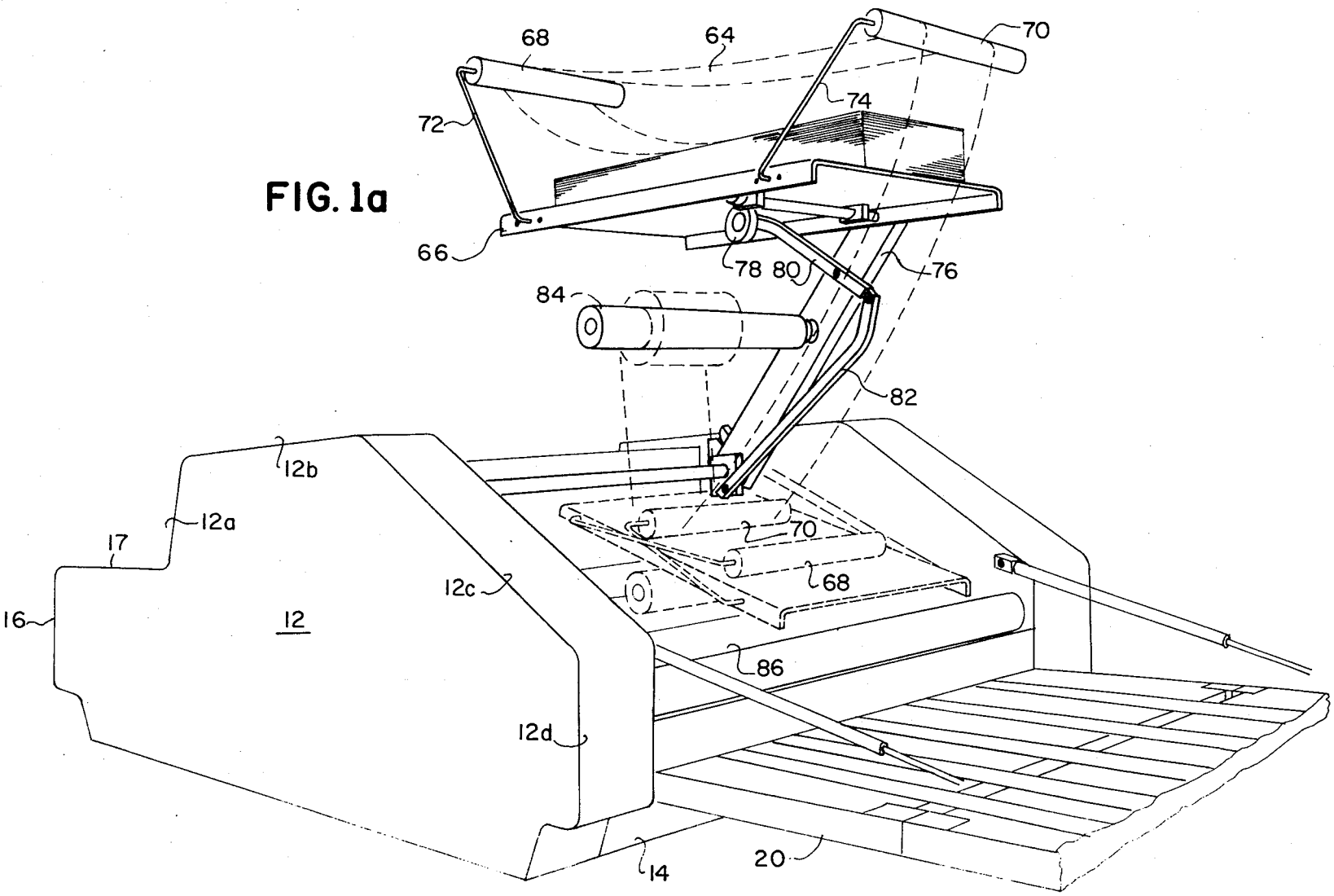
FIG. 1*a* is an enlarged perspective view, from a different angle, showing the retractable feeder support for the label carrier strip.

The labels that are applied to the envelopes in the processing station within the machine are carried by a carrier strip 64 (FIG. 1*a*). The means for feeding the carrier strip and for transferring the labels therefrom to the envelopes are not shown in the drawings since they form no part of the present invention, but reference may be made to the above-cited British specification for details thereof.

According to another feature of the present invention, the feeder for the carrier strip 64 is mounted on a retractable support which supports the feeder in a projected position (shown in full lines in FIG. 1*a*) external of the machine casing when the conveyor platform 20 is in its extended operative position, or in a retracted position (shown in broken lines in FIG. 1*a*) within the machine causing when the conveyor platform is in its folded non-operative position.

For the foregoing purpose, the feeder for carrier strip 64 includes a platform 66 supporting a pair of guide rollers 68, 70 for the carrier strip. Each roller is pivotably supported by arm 72, 74, either in an operative position (full lines in FIG. 1*a*) spaced above the platform, or in a non-operative position (broken lines in FIG. 1*a*) against the platform. Platform 66 is in turn supported by an arm 76 pivotably mounted at one end to the machine frame, and pivotably mounted at its opposite end side of platform 66. The opposite side of thhe platform is supported by a roller 78 carried by a pair of pivotable arms 80, 82. Roller 78 engages the underside of the platform and rolls therealong during the movement of the platform from its extended to its retracted position.

The feeder for carrier strip 64 further includes a take-up roll 84 carried by arm 76 intermediate its lengths, roll 84 including a coupling (not shown) to the drive motor for takingup the carrier strip after the labels have been removed and applied to the envelopes in the processing station. When platform 66 is retracted within the casing, roll 84 engages a ledge 86 within the machine for limiting the retracted position of the platform.

It will thus be seen that when the machine is not in use, the feeder for the label carrier strips 64 is in its retracted position, with platform 66 disposed within the case, and the two rollers 68, 70 pivoted against the platform, all as shown in broken-lines in FIG. 1*a*. The output feeder 20 may be then folded as shown in FIG. 3, with the conveyor platform sections 24 folded on their hinges to conform to the external configuration of the machine casing and to serve as part of the machine casing. In this folded condition, the machine forms a neat and compact unit, with all parts disposed within the machine.

When the machine is to be used, output feeder 20 is extended to its operative condition as shown in FIG. 1*a* to bring the platform and conveyor belts 26 into their extended positions for receiving the labelled envelopes outputted from the machine. At the same time, one of the guide rollers (e.g., roller 68) is gripped by the user and raised to withdraw platform 66 to its extended position as illustrated in full lines in FIG. 1*a*. These rollers are thus positioned to guide the carrier strip 64 as it is fed into the machine where the transfer of the labels carried thereby is effected to the envelopes fed from the input feeder 18.

While the invention has been desribed with respect to one preferred embodiment, it will be appreciated that the invention, or various features thereof illustrated, can be advantageously used in other applications as well.

What is claimed is:

1. An office machine comprising:

a machine casing;

means within the casing for processing a plurality of flat articles;

a first input feeder feeding the flat articles from a supply station at the input side of the casing to a processing station within the casing;

a second input feeder feeding further articles to the processing station to be processed with the flat articles from the supply station;

and an output feeder at the output side of the casing for feeding the articles away from the processing station;

said output feeder comprising a conveyor belt and a conveyor platform supporting the belt, the conveyor platform including a plurality of hinged sections permitting the platform and the conveyor belt supported thereby to be disposed in either an extended operating position wherein the hinged platform sections are extended for conveying the flat articles, or in a folded non-operating position wherein the hinged platform sections are folded over the machine casing;

said second input feeder including a retractable support supporting same in a projected position external of the machine casing when the conveyor platform is in its extended operative position, or in a retracted position within the machine casing when the conveyor is in its folded non-operative position.

2. An office machine as defined in claim 1, wherein said further articles are disposed in strip form, and wherein said second feeder includes a horizontal platform and a pair of guide rollers for said strip, each of said rollers being being pivotably mounted on said platform from an operative position spaced from the platform to a non-operative position against the platform, and a pivotable arm supporting the platform in said projected or retracted position.

3. An office machine as defined in claim 2, wherein said arm is pivotably mounted at one end to the office machine, and at the opposite end to one end of said feeder platform, the opposite end of the feeder platform being supported by a roller carried by a second arm pivotable to the machine, said latter roller engaging the underside of the feeder platform and rolling therealong during the movement of the platform from one to the other position thereof.

4. An office machine as defined in claim 2, wherein said pivotable arm further includes a strip take-up roll carried intermediate the length of the arm.

5. An office machine, as defined in claim 1, wherein said first input feeder includes an elongated member extending across the entrance thereof and formed with a rounded lower end facing said entrance, a roller disposed under the elongated member in alignment with its rounded lower end, and pivotable mounting means pivotably supporting the elongated member laterally of the axis of said roller in the direction towards said entrance, whereby the rounded lower end of the elongated member is urged against the roller by the weight of the elongated member, the surface friction of the roller being greater than that of the rounded lower end of the elongated member to effect the feed of one flat article at a time therebetween.

6. An office machine as defined in claim 5, further including a threaded pin for adjustably urging the rounded lower end of the elongated member against the roller.

7. An office machine as defined in claim 5, wherein said elongated member has a cross-sectional shape of a quarter-sector of a circle, and wherein said rubber disposed thereunder is made of soft sponge-rubber.

8. An office machine as defined in claim 5, wherein the first input feeder further includes an entrance plate at the entrance side of the elongated member and roller, said entrance plate having a tapered lower edge facing said entrance, spaced forwardly of the elongated member and roller, and above the line of engagement therebetween.

9. An office machine as defined in claim 5, wherein said first input feeder further includes a sensor for sensing the presence of articles in the supply station thereof, and a locking device locking said roller against rotation whenever the sensor senses the absence of articles of said supply station.

10. An office machine including a feeder for feeding flat articles from the bottom of a stack in a supply station; comprising: an elongated member extending across the entrance of the feeder and formed with a rounded lower end facing said entrance, said elongated member having a cross-sectional shape substantially of a quarter-sector of a circle; a roller disposed under the elongated member in alignment with its rounded lower end, and pivotable mounting means pivotably supporting the elongated member laterally of the axis of said roller in the direction towards said entrance, whereby the rounded lower end of the elongated member is urged against the roller by the weight of the elongated member, the surface friction of the roller being greater than that of the rounded lower end of the elongated member to effect the feed of one flat article at a time therebetween.

11. An office machine as defined in claim 10, further including a threaded pin for adjustably urging the rounded lower end of the elongated member against the roller.

12. An office machine as defined in claim 10, wherein the feeder further includes an entrance plate at the entrance side of the elongated member and roller, said entrance plate having a tapered lower edge facing said entrance, spaced forwardly of the elongated member and roller, and above the line of engagement therebetween.

* * * * *